US012540463B2

(12) United States Patent
Wales

(10) Patent No.: US 12,540,463 B2
(45) Date of Patent: Feb. 3, 2026

(54) SOAP DISPENSER IN A KITCHEN FAUCET WAND

(71) Applicant: Delta Faucet Company, Indianapolis, IN (US)

(72) Inventor: Joshua Drew Wales, Indianapolis, IN (US)

(73) Assignee: Delta Faucet Company, Indianapolis, IN (US)

( * ) Notice: Subject to any disclaimer, the term of this patent is extended or adjusted under 35 U.S.C. 154(b) by 849 days.

(21) Appl. No.: 17/842,362

(22) Filed: Jun. 16, 2022

(65) Prior Publication Data

US 2023/0016400 A1 Jan. 19, 2023

Related U.S. Application Data

(60) Provisional application No. 63/223,187, filed on Jul. 19, 2021.

(51) Int. Cl.
*E03C 1/046* (2006.01)

(52) U.S. Cl.
CPC ..... *E03C 1/0465* (2013.01)

(58) Field of Classification Search
CPC ..... E03C 1/0465
USPC ..... 239/312, 315, 316, 443–449, 560–562, 239/588
See application file for complete search history.

(56) References Cited

U.S. PATENT DOCUMENTS

| | | | | |
|---|---|---|---|---|
| 2,210,807 | A | 8/1940 | Fitzgerald | |
| 2,418,360 | A | 4/1947 | Matlack et al. | |
| 2,613,381 | A | 10/1952 | Tucker | |
| 3,581,996 | A | 6/1971 | Boyer | |
| 3,770,205 | A | 11/1973 | Proctor et al. | |
| 5,505,915 | A | 4/1996 | Copeland et al. | |
| 5,758,690 | A * | 6/1998 | Humpert | E03C 1/0404 4/678 |
| 5,957,387 | A | 9/1999 | Porta et al. | |
| 6,000,626 | A | 12/1999 | Futo et al. | |
| 8,418,654 | B2 | 4/2013 | Hurwitz | |
| 8,480,967 | B2 | 7/2013 | Zlatic et al. | |
| 8,815,171 | B2 | 8/2014 | Wagner | |
| 8,955,536 | B2 | 2/2015 | Bell et al. | |
| 9,821,279 | B2 | 11/2017 | Pasquier et al. | |
| 10,577,783 | B2 | 3/2020 | Farcet et al. | |
| 10,582,830 | B2 | 3/2020 | Fasson et al. | |
| 10,618,066 | B2 | 4/2020 | Rosko et al. | |

(Continued)

FOREIGN PATENT DOCUMENTS

| | | | |
|---|---|---|---|
| EP | 2351888 | A1 | 8/2011 |
| TW | 201110922 | A | 4/2011 |
| WO | 2017184915 | A1 | 10/2017 |

OTHER PUBLICATIONS

Indiegogo, Adithya Katragadda, Faucet Soap Dispenser, retrieved on Apr. 12, 2021 from https://www.indiegogo.com/projects/faucet-soap-dispenser#.

(Continued)

*Primary Examiner* — Christopher S Kim
(74) *Attorney, Agent, or Firm* — Bose McKinney & Evans LLP

(57) ABSTRACT

A sprayhead for use with a faucet including a soap compartment and a diverter valve configured to provide selective communication between the soap compartment and a water outlet.

13 Claims, 7 Drawing Sheets

(56) References Cited

U.S. PATENT DOCUMENTS

| | | | | |
|---|---|---|---|---|
| 2005/0189438 | A1* | 9/2005 | Bosio | E03C 1/0405 239/443 |
| 2007/0194153 | A1* | 8/2007 | Frazee | B05B 15/50 239/428.5 |

OTHER PUBLICATIONS

Thestruggleville, Evil to Garden Hose Nozzle with Soap Dispenser Review, retrieved on Apr. 12, 2021 from https://www.youtube.com/watch?v=cZUsrfyEvYw.

* cited by examiner

SOAP DISPENSER IN A KITCHEN FAUCET WAND

CROSS-REFERENCE TO RELATED APPLICATION

The present application claims priority to U.S. Provisional Patent Application Ser. No. 63/223,187, filed Jul. 19, 2021, the disclosure of which is expressly incorporated herein by reference.

BACKGROUND AND SUMMARY OF THE INVENTION

The present invention relates to a water delivery device and, more particularly, to a faucet including a sprayhead or wand having a soap dispenser.

The present disclosure provides a convenient and eco-friendly way to provide soap through the wand or sprayhead of a kitchen faucet for doing dishes or hand washing, etc. The illustrative sprayhead of the present disclosure accomplishes such objectives with minimal cost/design impact or complexity, and in such a way that it is retrofittable to an existing faucet. The illustrative sprayhead is further configured to reduce plastic waste associated with single use plastic liquid soap containers.

The illustrative sprayhead of the present disclosure is provided with a soap compartment to receive a soap, such as a solid soap (e.g., powdered or tablet soap), a concentrated liquid soap, or a semi-solid soap (e.g., a gel). The illustrative sprayhead includes a momentary pushbutton diverter valve to divert water through the soap compartment to create soapy water. Soap is illustratively placed into the sprayhead by the user through an access port, such as an opening covered by a watertight door. Solid soap eliminates the need for plastic soap bottles, is lighter, and requires fewer carbon emissions in shipping. Concentrated solid soap also increases the amount of soap that can be contained in the sprayhead and reduces the complexity of implementation.

According to an illustrative embodiment of the present disclosure, a faucet includes a delivery spout defining a passageway, a water supply tube slidably received within the passageway of the delivery spout, and a sprayhead removably coupled to the delivery spout. The sprayhead includes an inlet fluidly coupled to the water supply tube, an outlet, and a soap compartment in fluid communication with the outlet and configured to receive a solid soap. A soap diverter valve is configured to provide selective communication between the inlet and the outlet.

According to a further illustrative embodiment of the present disclosure, a sprayhead includes an outer shell, a waterway received within the outer shell, the waterway defining an inlet, a first outlet, a second outlet, and a soap compartment in fluid communication with the second outlet and configured to receive a solid soap. A soap diverter valve is configured to provide selective communication between the inlet and one of the first outlet or the second outlet, wherein the soap diverter valve comprises a momentary diverter valve. The momentary diverter valve in a first mode provides fluid communication between the inlet and the first outlet, and the momentary diverter valve in a second mode provides fluid communication between the inlet and the second outlet. The momentary diverter valve is biased toward the first mode.

According to another illustrative embodiment of the present disclosure, a faucet includes a delivery spout defining a passageway, a water supply tube slidably received within the passageway of the delivery spout, and a sprayhead removably coupled to the delivery spout. The sprayhead includes an inlet fluidly coupled to the water supply tube, a first outlet, a second outlet, and a soap compartment in fluid communication with the second outlet and configured to receive a solid soap. A soap diverter valve is configured to provide selective communication between the inlet and one of the first outlet or the second outlet, wherein the soap diverter valve comprises a momentary diverter valve. The momentary diverter valve in a first mode provides fluid communication between the inlet and the first outlet, and the momentary diverter valve in a second mode provides fluid communication between the inlet and the second outlet. The momentary diverter valve is biased toward the first mode. A moveable door is operably coupled to the outer shell to provide access to the soap compartment, and a seal is positioned intermediate the door and the outer shell. A flow restrictor is positioned between the soap diverter valve and the soap compartment to control the flow of water.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying Figures in which.

DETAILED DESCRIPTION OF THE DRAWINGS

Figure 1:
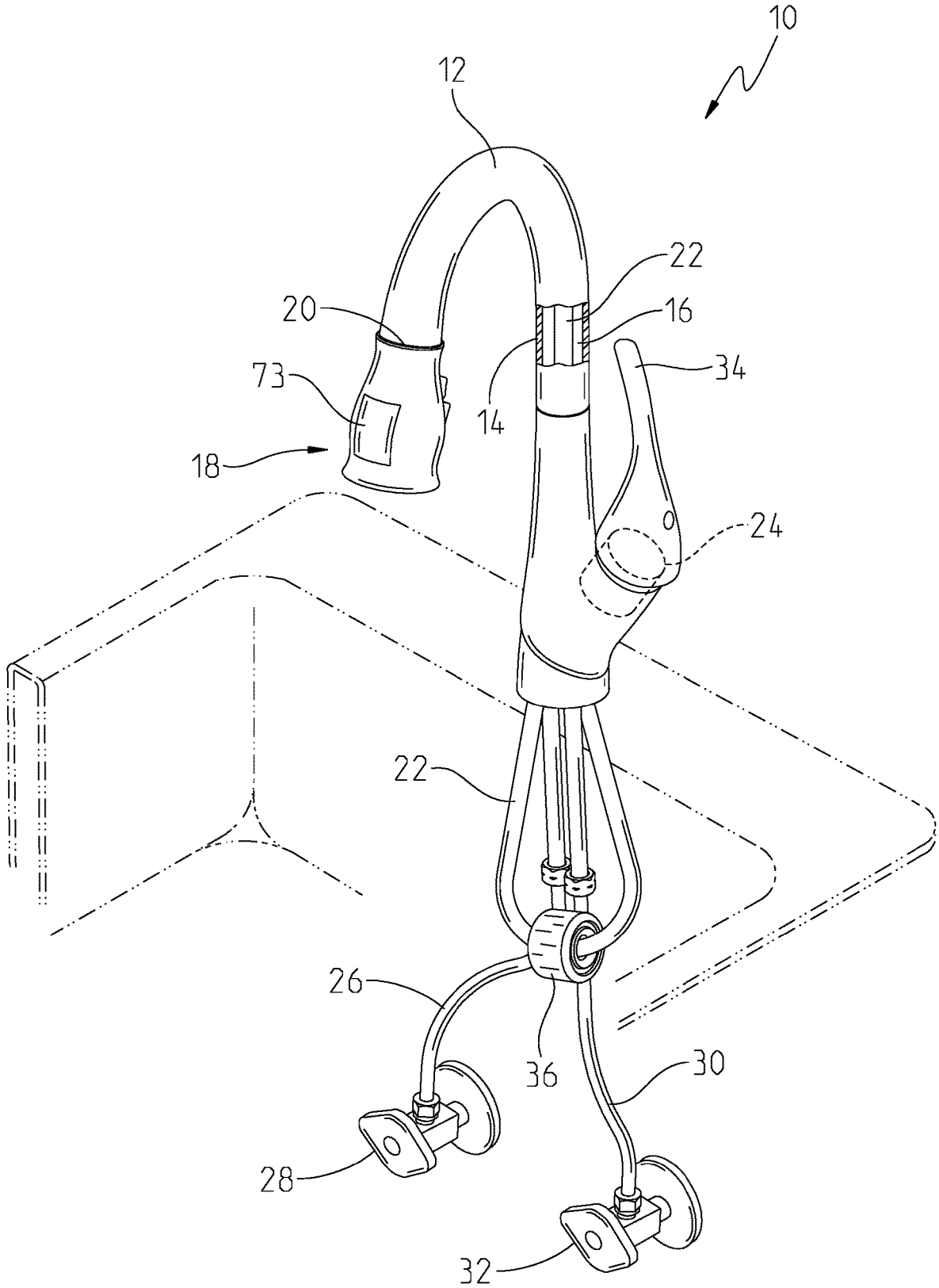
FIG. 1 is a perspective view of an illustrative faucet including a sprayhead of the present disclosure, with a partial cut-away of the delivery spout.

Referring initially to FIG. 1, an illustrative faucet 10 is shown as including a delivery spout 12 including a tubular side wall 14 defining an internal passageway 16. An illustrative sprayhead 18 is removably coupled to an outlet end 20 of the delivery spout 12. A water supply tube 22 operably couples the sprayhead 18 to a mixing valve 24 and is slidably received with the passageway 16 of the delivery spout 12. A hot water supply tube 26 fluidly couples a hot water source 28 (e.g., a hot water valve stop) to the mixing valve 24, and a cold water supply tube 30 fluidly couples a cold water source 32 (e.g., a cold water valve stop) to the mixing valve 24. A handle 34 is operably coupled to the mixing valve 24. As is known in the art, user manipulation of the handle 34 causes movement of a valve member (not shown) to alter the flow rate and temperature of water delivered to an outlet of the mixing valve 24 and, hence, to the water supply tube 22. An illustrative mixing valve 24 is detailed in U.S. Pat. No. 7,753,074 to Rosko et al., the disclosure of which is expressly incorporated herein by reference. A hose retractor (e.g., a hose weight 36) may be operably coupled to the water supply tube 22 and is configured to retract the sprayhead 18 toward the outlet end 20 of the delivery spout 12 by pulling the tube 22 downwardly.

Figure 2:
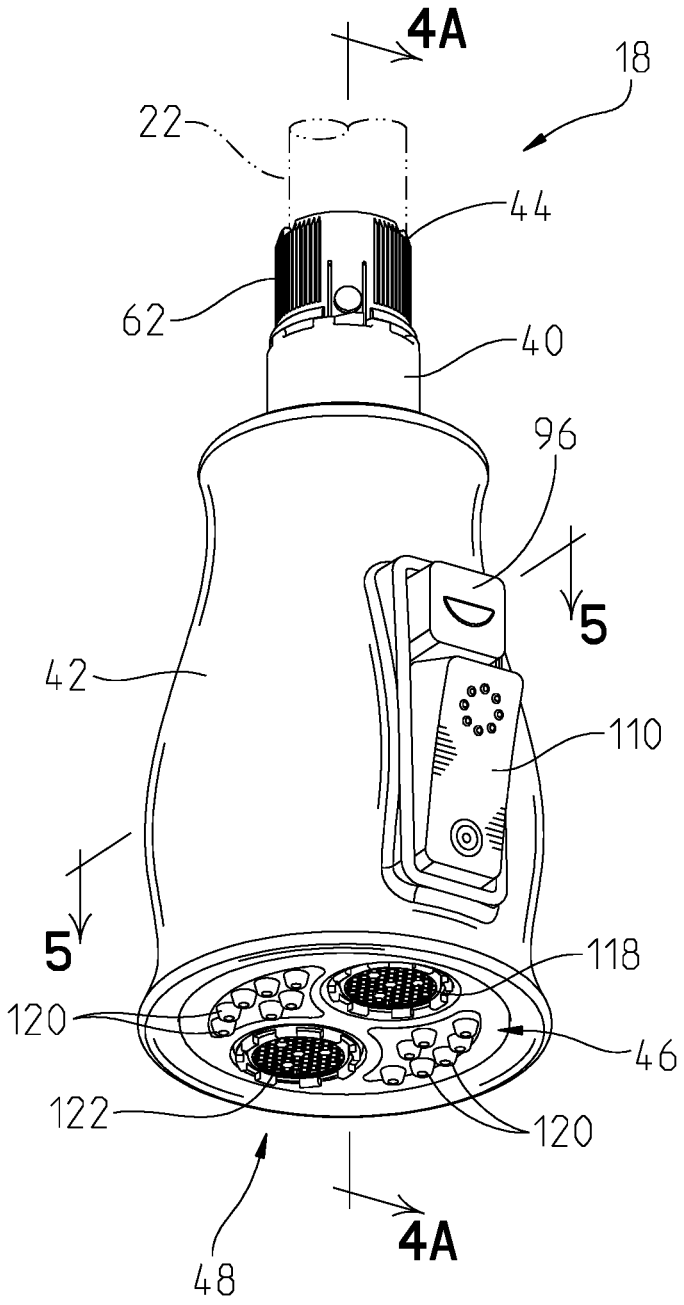
FIG. 2 is a perspective view of the sprayhead of the present disclosure.
Figure 3:
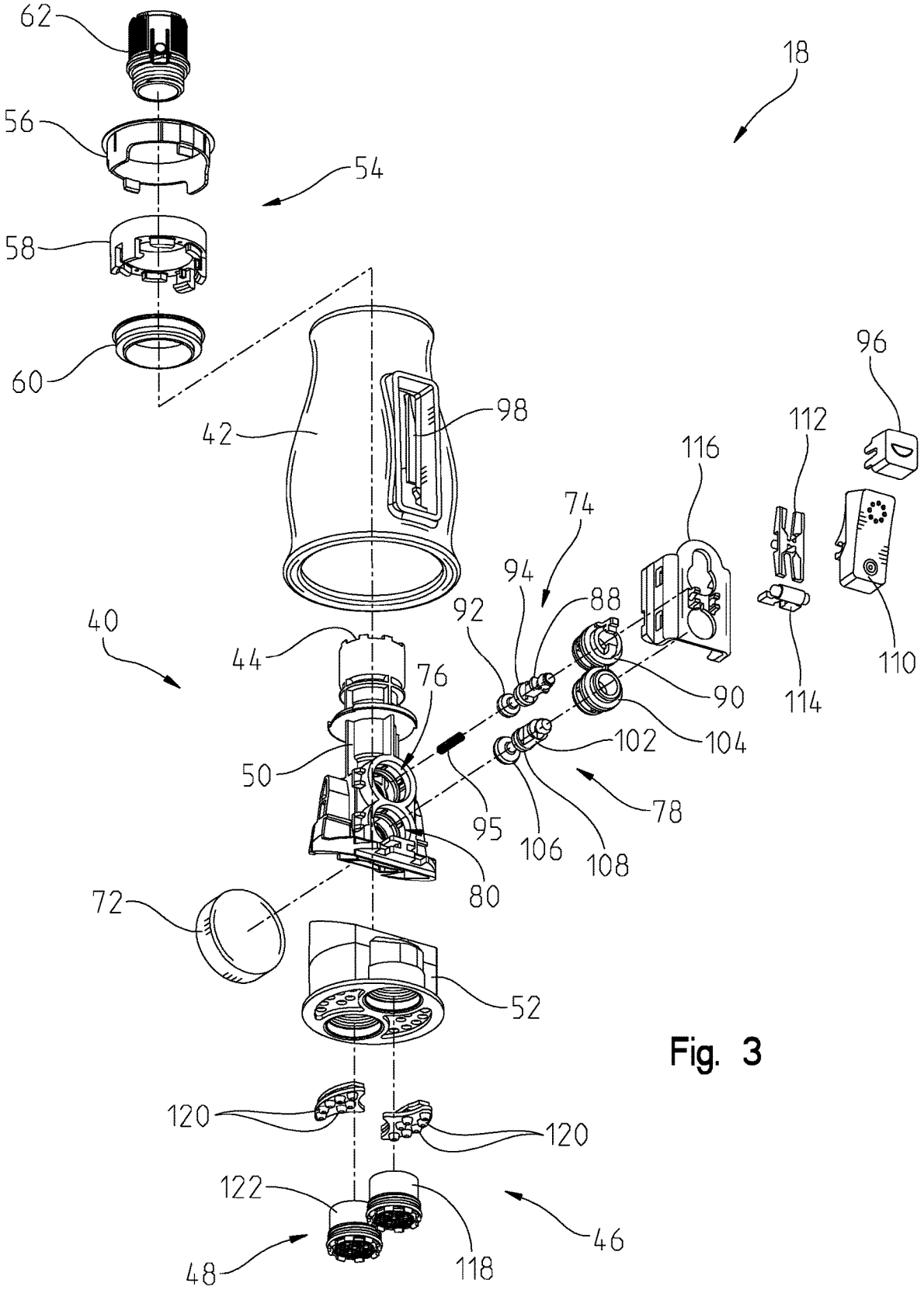
FIG. 3 is an exploded perspective view of the sprayhead of FIG. 2.

With reference to FIGS. 2 and 3, the sprayhead 18 illustratively includes a waterway 40 received within an outer shell 42. The illustrative waterway 40 defines an inlet 44 fluidly coupled to the water supply tube 22, a first outlet 46, and a second outlet 48. In alternative embodiments, the illustrative waterway 40 may include a single outlet, or more than two outlets. The waterway 40 may include a first or main body portion 50 and a second or outlet body portion 52. The first portion 50 and the second portion 52 may be formed of separate molded polymer components. Alternatively, the waterway 40 may be formed of additional components, or as a single molded piece.

A retainer 54 illustratively secures the waterway 40 to the outer shell 42. The retainer 54 illustratively includes cooperating outer and inner rings 56 and 58, a threaded washer 60, and an annular gasket 61. A conventional fluid coupler 62, illustratively a hose retainer nut, may fluidly couple the inlet 44 of the waterway 40 to the water supply tube 22. Check valves 64 and 66 may be received within the waterway 40 downstream from the inlet 44.

Figure 4A:
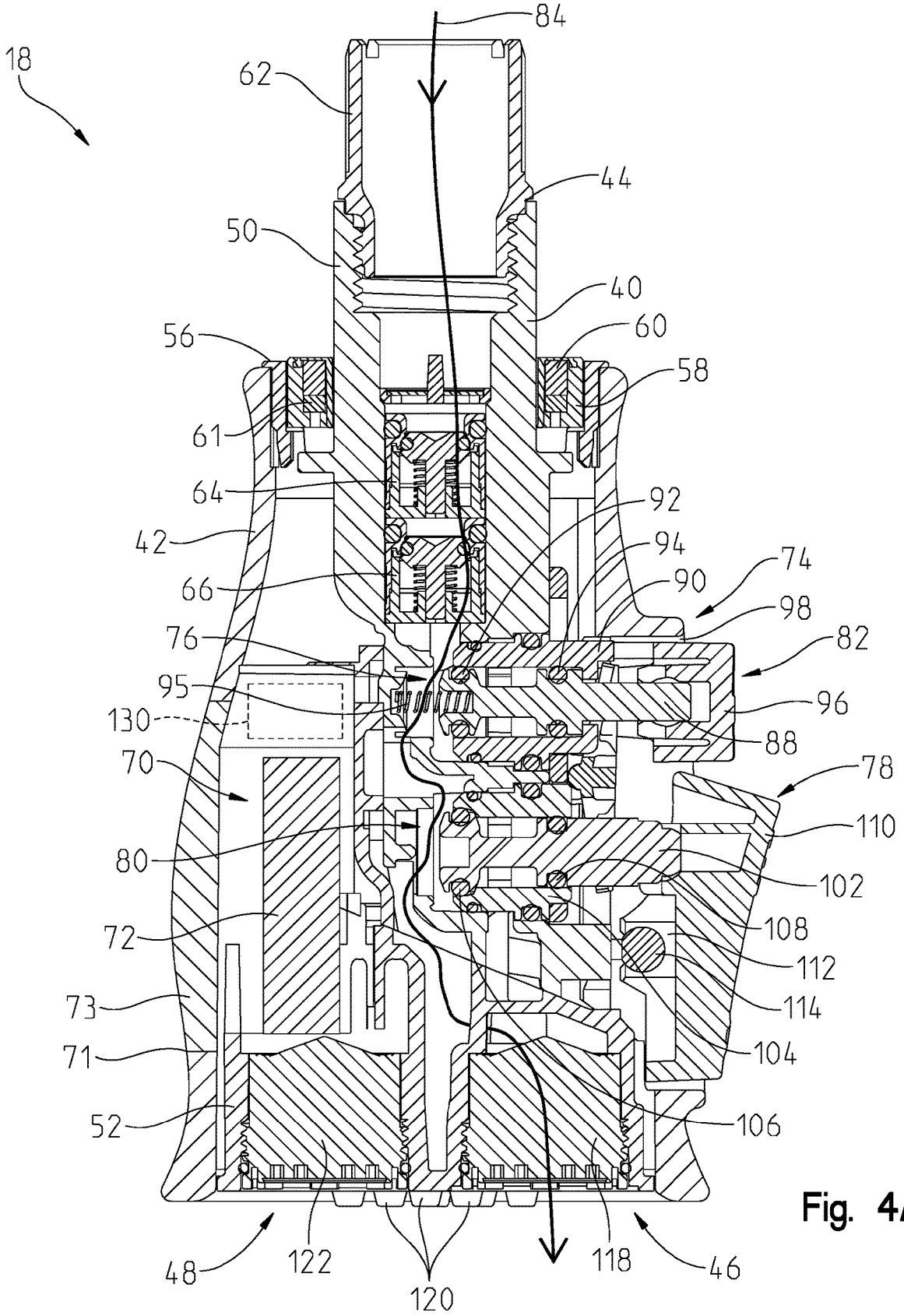
FIG. 4A is a cross-sectional view of the sprayhead taken along line 4A-4A of FIG. 2, showing the soap diverter valve in a first mode of operation and the mode diverter valve in a stream mode of operation.
Figure 4B:
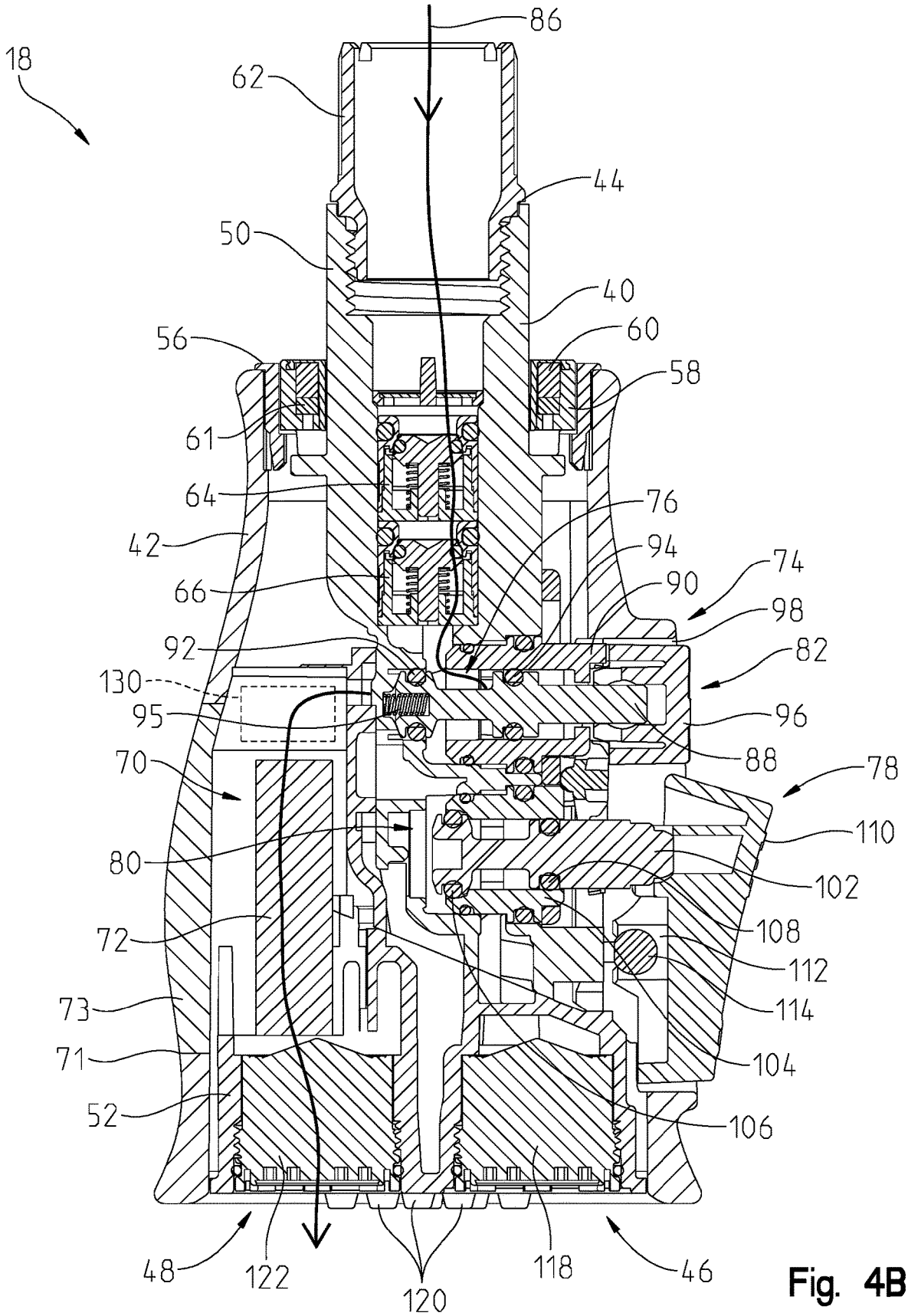
FIG. 4B is a cross-sectional view of the sprayhead similar to FIG. 4A, showing the soap diverter valve in a second mode of operation.
Figure 5:
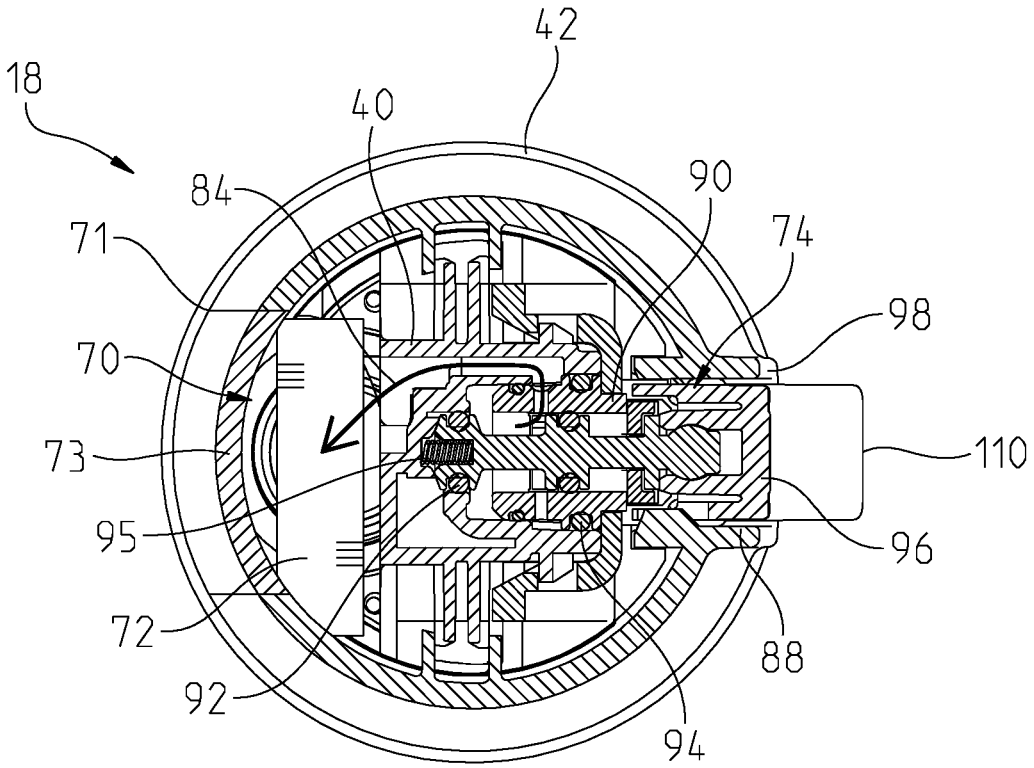
FIG. 5 is a cross-sectional view of the sprayhead taken along line 5-5 of FIG. 2, showing the soap diverter valve in a second mode of operation.
Figure 6:
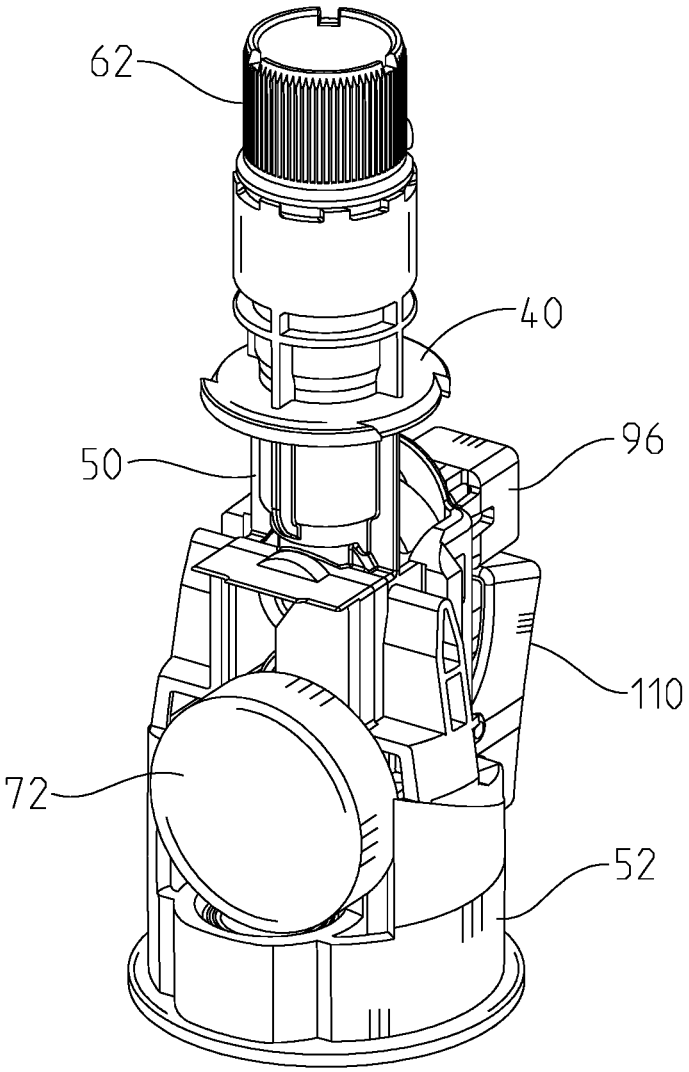
FIG. 6 is a perspective view of the waterway of the sprayhead of FIG. 2, showing a soap tablet for positioning in the soap compartment.

With reference to FIGS. 4A-5, a soap compartment 70 is in fluid communication with the second outlet 48 and is configured to receive a soap 72, such as a solid soap, a concentrated liquid soap, or a semi-solid soap (e.g., a gel). Illustratively, the soap 72 comprises a solid soap powder or solid soap tablet. An access port or opening 71 may be formed within the shell 42 for installing the soap 72 within the soap compartment 70. Illustratively, a door 73 may cover the opening 71 and be releasably coupled to the shell 42.

A soap diverter valve 74 is illustratively received within a first diverter chamber 76 of the first portion 50 of the waterway 40, and is in fluid communication with, and downstream from, the inlet 44. A spray mode diverter valve 78 is illustratively received within a second diverter chamber 80 of the first portion 50 of the waterway 40, and is in selective fluid communication with, and downstream from, the soap diverter valve 74.

The soap diverter valve 74 is configured to provide selective communication between the inlet 44 and at least one of the first outlet 46 or the second outlet 48. The soap diverter valve 74 illustratively comprises a momentary diverter valve 82 having a first mode of operation for providing fluid communication between the inlet 44 and the first outlet 46 (via the spray mode diverter valve 78), and a second mode of operation providing fluid communication between the inlet 44 and the second outlet 48 (via the soap compartment 70). In other illustrative embodiments, the soap diverter valve 74 may be a non-momentary diverter valve including, for example, a button or rocker switch that may be maintained in either the first mode of operation or the second mode of operation.

In the illustrative embodiment, a first passageway or flow path 84 (FIG. 4A) provides for the flow of water from the inlet 44 through the soap diverter valve 74 to the spray mode diverter valve 78 and to the first outlet 46. A second passageway or flow path 86 (FIG. 4B) provides for the flow of water from the inlet 44 through the soap diverter valve 74 to the soap compartment 70 and out of the second outlet 48. As further detailed herein, the soap diverter valve 74 toggles water flow between the first passageway 84 and the second passageway 86.

The momentary diverter valve 82 illustratively includes a piston or shaft 88 slidably received within the first diverter chamber 76. The piston 88 is retained within the waterway 40 by a valve housing or retainer 90. Seals 92 and 94, such as o-rings, are supported by the piston 88. A spring 95 biases the piston 88 toward the first mode of operation. A push button 96 is operably coupled to the piston 88 and extends within an opening 98 in the outer shell 42. As may be appreciated, a user pressing the push button 96 causes the piston 88 to act against the spring 95.

The mode diverter valve 78 illustratively includes a piston or shaft 102 slidably received within the second diverter chamber 80. The piston 102 is retained within the waterway 40 by a valve housing or retainer 104. Seals 106 and 108, such as o-rings, are supported by the piston 102. A rocker switch 110 includes a support 112 operably coupled to a pivot 114 for pivoting movement to axially move the piston 102. The rocker switch 110 extends through the opening 98 in the outer shell 42. A valve cap or bracket 116 is operably coupled to the waterway 40 to secure the valve retainers 90 and 104 thereto.

The first outlet 46 illustratively includes a conventional flow device, such as an aerator 118. The first outlet 46 may also include a plurality of spray outlets 120, such as conventional spray nozzles. The spray mode diverter valve 78 may be provided downstream from the soap diverter valve 74 and is configured to provide selective communication between the soap diverter valve 74 and one of the aerator 118 and the plurality of spray nozzles 120. The second outlet 48 illustratively includes a conventional flow device, such as an aerator 122.

In operation, water from the hot water source 28 and the cold water source 32 is provided to respective inlets of the mixing valve 24. By a user operating the handle 34, the outlet of the mixing valve 24 provides water to the water supply tube 22. Water from the water supply tube 22 flows into the inlet 44 of the waterway 40 of the sprayhead 18. With the soap diverter valve 74 in the first mode as shown in FIG. 4A, water is directed along the passageway 84 to the mode diverter valve 78. As may be appreciated, this first mode of the soap diverter valve 74 is the normal or default mode due to the biasing force of the spring 95 acting against the piston 88 (e.g., forcing the piston 88 to the right as shown in FIG. 4A).

The spray mode diverter valve 78 may operate in a conventional manner. In the position shown in FIG. 4A, water from the soap diverter valve 74 is directed by the spray mode diverter valve 78 to the aerator 118 of the first outlet 46, thereby defining a stream mode of operation. By the user pivoting the rocker switch 110 about the pivot 114 (e.g., counter-clockwise as shown in FIG. 4A), the piston 102 is moved to a second position (e.g., to the left in FIG. 4A) and thereby directs water to the spray nozzles 120 of the first outlet 46.

By the user depressing the button 96, the soap diverter valve 74 operates in the second mode as shown in FIG. 4B. In this mode, water is directed from the inlet 44 of the waterway 40 along the passageway 86 to the soap compartment 70. Water passes over the soap tablet 72 such that soapy water is discharged from the aerator 122 of the second outlet 48. When the user releases the button 96, the spring 95 forces the piston 88 back to the first mode of the soap diverter valve 74 (e.g., to the right as shown in FIG. 4A).

In an illustrative embodiment, a mixing device 130 may be fluidly coupled to the soap compartment 70. More particularly, the mixing device 130 may be installed upstream of the soap compartment 70 to facilitate dissolving of the soap tablet 72 into the water. The illustrative mixing device 130 can be any device that agitates the water flow to facilitate the interaction between the soap tablet 72 and the water, such as, for example, a venturi, a turbine, a dispersing mechanism, mixing vanes, etc.

Although the invention has been described in detail with reference to certain preferred embodiments, variations and modifications exist within the spirit and scope of the invention as described and defined in the following claims.

The invention claimed is:

1. A faucet comprising:

a delivery spout defining a passageway;

a water supply tube slidably received within the passageway of the delivery spout; and a sprayhead removably coupled to the delivery spout, the sprayhead including:

an inlet fluidly coupled to the water supply tube;

a first outlet and a second outlet;

a soap compartment in fluid communication with the outlet and configured to receive a soap; and a soap diverter valve configured to provide selective communication between the inlet and the soap compartment, the soap diverter valve having a first mode providing fluid communication between the inlet and the first outlet and bypassing the soap compartment and a second mode providing fluid communication between the inlet and the second outlet through the soap compartment; and further comprising a spray mode diverter valve positioned downstream from the soap diverter valve and upstream of the first outlet, the first outlet having a first portion defining a first spray pattern and second portion defining a second spray pattern, the spray mode diverter valve being configured to provide selective communication between one of the first portion and the second portion of the first outlet.

2. The faucet of claim 1, wherein the first outlet includes an aerator and a plurality of spray nozzles, and the first portion of the first outlet is defined by the aerator and the second portion of the first outlet is defined by the plurality of spray nozzles.

3. A sprayhead comprising:

an outer shell;

a waterway received within the outer shell, the waterway defining an inlet, a first outlet and a second outlet;

a soap compartment in fluid communication with the second outlet and configured to receive a solid soap;

a soap diverter valve configured to provide selective communication between the inlet and one of the first outlet and the second outlet, wherein the soap diverter valve comprises a momentary diverter valve, the momentary diverter valve in a first mode providing fluid communication between the inlet and the first outlet, and the momentary diverter valve in a second mode providing fluid communication between the inlet and the second outlet via the soap compartment, the momentary diverter valve comprising a spring biasing the momentary diverter valve toward the first mode; and a spray mode diverter valve downstream from the soap diverter valve, the first outlet including an aerator and a plurality of spray nozzles, the spray mode diverter valve configured to provide selective communication between the soap diverter valve and one of the aerator and the plurality of spray nozzles.

4. The sprayhead of claim 3, further comprising a movable door operably coupled to the outer shell to provide access to the soap compartment, and a seal positioned intermediate the door and the outer shell.

5. The sprayhead of claim 3, further comprising a flow restrictor positioned between the soap diverter valve and the soap compartment to control a flow of water between the soap diverter valve and the soap compartment.

6. The sprayhead of claim 3, wherein the momentary diverter valve includes a piston and the spring biases the piston toward the first mode.

7. The sprayhead of claim 6, wherein a user-accessible push button is operably coupled to the piston whereby pressing of the push button moves the momentary diverter valve to the second mode.

8. The sprayhead of claim 3, further comprising a check valve positioned between the inlet and the soap diverter valve.

9. A sprayhead comprising:

an outer shell;

a waterway received within the outer shell, the waterway defining an inlet, a first outlet and a second outlet;

a soap compartment in fluid communication with the second outlet and configured to receive a solid soap wherein the solid soap comprises a soap tablet; and a soap diverter valve configured to provide selective communication between the inlet and one of the first outlet and the second outlet, wherein the soap diverter valve comprises a momentary diverter valve, the momentary diverter valve in a first mode providing fluid communication between the inlet and the first outlet, and the momentary diverter valve in a second mode providing fluid communication between the inlet and the second outlet via the soap compartment, the momentary diverter valve comprising a spring biasing the momentary diverter valve toward the first mode.

10. A faucet comprising:

a delivery spout defining a passageway;

a water supply tube slidably received within the passageway of the delivery spout; and a sprayhead removably coupled to the delivery spout, the sprayhead including:

an inlet fluidly coupled to the water supply tube;

a first outlet;

a second outlet;

a soap compartment in fluid communication with the second outlet and configured to receive a solid soap;

a soap diverter valve configured to provide selective communication between the inlet and one of the first outlet and the second outlet, wherein the soap diverter valve comprises a momentary diverter valve, the momentary diverter valve in a first mode providing fluid communication between the inlet and the first outlet, and the momentary diverter valve in a second mode providing fluid communication between the inlet and the second outlet via the soap compartment, the momentary diverter valve comprising a spring biasing the momentary diverter valve toward the first mode;

a movable door operably coupled to the outer shell to provide access to the soap compartment, and a seal positioned intermediate the door and the outer shell;

a flow restrictor positioned between the soap diverter valve and the soap compartment to control a flow of water between the soap diverter valve and the soap compartment; and a spray mode diverter valve downstream from the soap diverter valve, the first outlet including an aerator and a plurality of spray nozzles, the spray mode diverter valve configured to provide selective communication between the soap diverter valve and one of the aerator and the plurality of spray nozzles.

11. The faucet of claim 10, wherein the momentary diverter valve includes a piston and the spring biases the piston toward the first mode.

12. The faucet of claim 10, wherein a user-accessible push button is operably coupled to the piston whereby pressing of the push button moves the momentary diverter valve to the second mode.

13. The faucet of claim 10, further comprising a check valve positioned between the inlet and the soap diverter valve.

* * * * *